United States Patent [19]

Ebenstein

[11] 4,044,437

[45] Aug. 30, 1977

[54] RESILIENT HAND LOOM GRID

[76] Inventor: Ruth B. Ebenstein, 2685 Glendessary Lane, Santa Barbara, Calif. 93105

[21] Appl. No.: 668,431

[22] Filed: Mar. 19, 1976

[51] Int. Cl.[2] ..... D03D 29/00

[52] U.S. Cl. ..... 28/151

[58] Field of Search ..... 28/15; 66/4; 139/34

[56] References Cited

U.S. PATENT DOCUMENTS

| | | | |
|---|---|---|---|
| 951,935 | 3/1910 | Boydston et al. | 28/15 |
| 1,427,769 | 9/1922 | Anthony | 28/15 |
| 1,975,924 | 10/1934 | Collingbourne | 28/15 |
| 2,088,455 | 7/1937 | Witt | 28/15 |
| 2,134,066 | 10/1938 | Van Ness | 66/4 |
| 2,305,613 | 12/1942 | Golden | 28/15 |
| 2,703,482 | 3/1955 | Auran | 66/4 |

*Primary Examiner*—Louis K. Rimrodt
*Attorney, Agent, or Firm*—James E. Hawes

[57] ABSTRACT

The described hand loom is formed of a resilient sheet and includes resilient, durable peripheral bars projecting beyond the sheet, the bars being of a size and location to permit threads to be wrapped about them. Preferably, the loom is injection molded as a plastic grid, includes peripheral bars that may hold both warp and weft threads, or loops of a knitted fabric, the bars and sheet being co-planar. The loom may be formed in any of a variety of shapes, and may include an interior opening with bars projecting into it permitting the weaving or knitting process to extend over the outer edge of the sheet or from one side to the other side. A new method of weaving also is described.

7 Claims, 7 Drawing Figures

RESILIENT HAND LOOM GRID

BACKGROUND

Weaving is an ancient art that has employed many different kinds of looms, looms ranging from simple hand held structures to complex floor mounted machines.

Perhaps one of the most common hand looms today is the loom that is used for weaving potholders from loops. This loom is a rigid loom, in the form of a square with projecting fingers designed to hold the warp loops and the woven weft loops. After weaving a holder, the ends of the loops are chained to one another to complete the article. A hand loom can be formed from a piece of cardboard cut or perforated on opposite edges to receive and hold warp threads. Inherent in the nature of the weaving process is the fact that as the weaving progresses, the tension in the warp threads will increase, or their span decrease, because of the increasing number of interwoven weft threads. This places increasing tension upon such a cardboard hand loom and can often result in a fold developing in the cardboard sheet, especially of continued handling required by the weaving process, the fold destroying the ability of the cardboard to maintain the warp threads reasonably taut. Even if such a fold does not develop, the process of removing the woven article from the loom usually destroys the edge of the cardboard, thus limiting the use of such a loom to a single article. In addition, because of the nature of such a loom, the slots holding the warp threads must be spaced a distance sufficient to retain adequate strength along the periphery of the cardboard sheet to hold the warp threads. Thus, usually such a loom is limited to at most four or six warp threads per inch.

Hand held looms could be ideal instruments for teaching the process of, and developing skill at, weaving. Were the limitations and difficulties, such as just noted, not present in such looms, they would afford an ideal teaching tool. Such a tool would permit the student to concentrate attention on the weaving process and experiment with variations and techniques without fear of destroying the loom or violating its structure. In addition, were such a loom also capable of being employed in knitting projects, it would not only increase significantly its usefulness but also provide a very valuable teaching too. Of course, hand held looms can be and should be quite inexpensive to permit them to be acquired by students and multiple looms used to hold various articles being woven without substantial investment in the loom structure.

BRIEF DESCRIPTION OF THE INVENTION

The resilient hand loom of the present invention is well adapted to being an ideal small loom, attaining the objectives just noted in a simple, inexpensive, and highly versatile structure. It consists of a resilient sheet incorporating a series of regularly spaced openings to define a grid, the sheet bearing peripheral bars projecting beyond the sheet. These peripheral bars are of a material that is sufficiently resilient to cause the bars to return to their original shape even after being repeatedly bent back upon the sheet. For weaving projects, the bars should be of a size and location to permit warp threads to be wrapped about them at a density of eight threads per inch reasonable for most weaving materials and projects. Preferably the loom is injection molded from a thermo-plastic material with the peripheral bars lying in the plane of the resilient sheet. Such peripheral bars also may be provided to hold weft threads as well as the warp threads. The bars further may be employed in various knitting projects as well. Indeed, the pattern defined by the grid of the loom may be varied to suit the purpose of the loom, radial and circumferential bars being well suited to some applications. An opening may be provided within the interior of the loom and peripheral bars left to project into this opening.

Such a novel structure affords the user a versatility unmatched by any other loom, even permitting articles to be woven over the edge of the sheet from one side around to the other side of the loom, or articles generated that are a combination of woven and knitted sections. Such a loom may be cut, or formed, in the pattern of the object to be woven.

A method of weaving also is disclosed which employs a structure such as the resilient hand loom just described, the loom preferably having a central opening. The method consists of fixing warp threads in a pattern within a peripheral margin of the loom, then passing these warp threads over the outer edge of the loom to the opposite face. They may be attached to this face, or pass over the opposite face to terminate, after being extended over another peripheral edge of the loom, in an attachment to the same face to which the first end was attached. This arrangement of warp threads permits the weft threads to be woven over the edge of the resilient loom to, when the weaving process is completed, define an article in the shape of the periphery of the loom. Where the warp threads pass completely over one face of the loom, the woven article will have a solid face woven to a face with a central opening. Such an article, for example, may be woven in the form of a beret or slipper. A method of knitting also is described that employes the hand loom.

BRIEF DESCRIPTION OF THE DRAWINGS

The invention will be further described with reference to the accompanying drawings in which.

DETAILED DESCRIPTION OF THE INVENTION

The preferred hand loom is a deceptively simple device. Only when compared with previous hand looms do its significant advantages unfold. To an inexperienced user, the hand loom seems simply to be resilient plastic grid with bars about its periphery. In the hands of an experienced user, the elegance of its simplicity permits rapid construction of an endless variety of woven and knitted shapes, even shapes heretofore unattainable by the most complex of looms.

Figure 1:
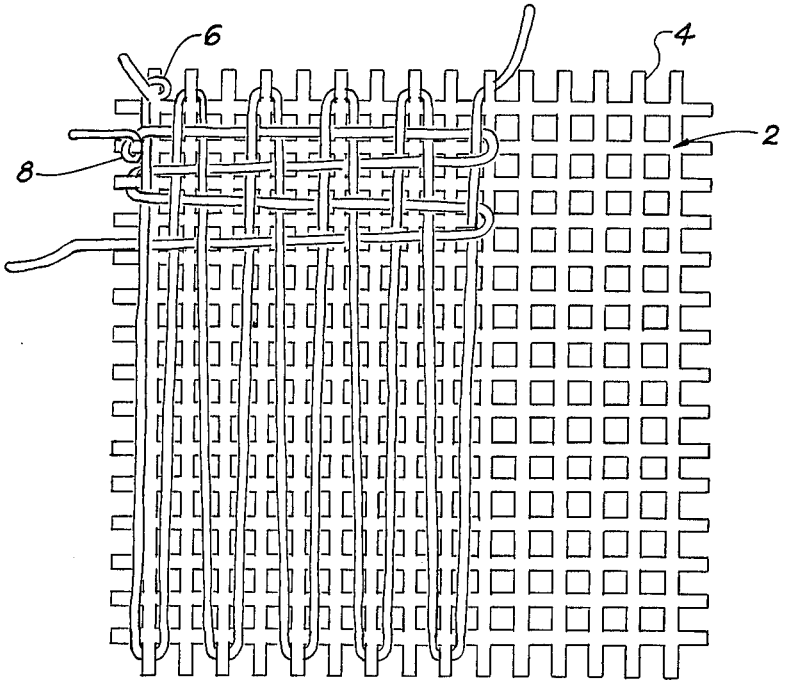
FIG. 1 is a plan view of a preferred form of the resilient hand loom upon which an article partially has been woven.

As shown in FIG. 1, the preferred hand loom is formed as a resilient sheet 2 bearing about its periphery a series of prongs or bars 4, preferably being co-planar with the sheet. This configuration may be formed economically in various sizes and shapes by injection molding it of a plastic material such as polyethelyne. Portions of this resilient sheet may be left open to provide a series of regularly spaced openings. The remaining material defines a grid or matrix as shown in FIG. 1, resulting in an article with a series of parallel plastic bars or filaments interwoven with a second series at right angles to the first. Such a structure has a number of advantages, as will be explained herein.

Each peripheral prong or bar may be individually bent, or sections of bars may be bent, without disturbing the other bars. This permits the weaver to work selected warp threads while the loom holds the rest secure in light tension. Preferably the peripheral bars are spaced close enough to receive standard hand loom weaving materials at a normal woven density, for example eight bars per inch. This yields a woven material of a density typical of more expensive precision looming machines. For the purposes of more clearly illustrating other features of the invention, a spacing of about five peripheral bars per inch is shown in FIG. 1. However, much finer or coarser spacing may be used, as will be desired in some weaving projects such as for bead work or basketry.

The hand loom is employed to weave an article by first working one end of a warp thread 6 about one of the peripheral bars. Normally the warp thread then passes over the central grid 2 to the opposite periphery and is looped about another peripheral bar as indicated in FIG. 1. This process is continued, running the warp thread back and forth, looping it about opposed peripheral bars on each cycle. When warp of a sufficient size for the intended shape of the woven product has been so provided, weft thread 8 may be fixed between, or passed about, one of the peripheral bars, then interwoven with the warp threads in a conventional manner as detailed in FIG. 1.

One approach for so interweaving the warp threads may use a needle (or bobbin or shuttle) whose body is employed to depress selected warp threads as the point picks up successive threads in the desired pattern until the weft thread and needle have been interlaced with the warp threads for the entire width of the pattern, the needle then being pulled free and snug to complete one line of the woven product. This process is repeated until the entire product is woven. Of course, as a greater and greater amount of weft thread is interlaced with the warp threads, the tension of the warp threads will increase. This tension tends to bend or deflect the resilient bars holding the warp threads. Because of the preferred resilience of the sheet 2, the sheet will bend in response to this increasing tension and automatically maintain and preserve to a large extent a constant light tension in the warp threads.

A shed stick may be employed, even in work of potholder size, when using this new hand loom. The use of a shed stick on many known hand looms will tend to lift the warp threads from their pegs as the warp tension increases. The flexibility and resilience of this new loom permits the use of a shed stick and even a shuttle without tending to unseat warp threads from the loom.

It is often useful to extend weft threads from one periphery of the hand loom to the opposite periphery, looping the thread about the next resilient bar at each cycle of weaving. This helps the beginning weaver to produce a flat article of standard size and to control the margin defined by the weft threads. Upon completing the woven product, the warp and weft threads are removed easily by bending the loom and lifting the weaving from the peripheral bars of the hand loom. The resilient bars hold the threads well, but permit them to be removed without difficulty. Were the bars perpendicular to the plane of the sheet 2, as in some previous hand looms, the threads would tend to slip from the bars even during the flexing normal to the weaving process, which, of course, is quite undeniable.

As previously noted, the hand loom admits an infinite variety of weaving projects. Only a portion of the loom may be employed in the weaving project, as is illustrated in FIG. 1, or the entire loom may be employed, both warp and weft threads running completely across the loom from one peripheral bar to the opposite bar. Also, because of the shaping and spacing of the peripheral bars, the preferred embodiment of the hand loom may hold an intermediate segment of the warp thread permitting quite long warp threads to be woven a portion at a time with the hand loom. To do this, the warp thread may be looped or otherwise secured about the peripheral bars on opposed edges of the panel, or simply tucked between the bars, and the weft threads woven through only the portion of the warp threads supported by the loom. When such a section of weaving is substantially complete, the warp threads are removed from the loom and a new section is positioned for the weaving, the woven section being pinned or otherwise resecured to the loom. In this fashion, a long band or belt may be woven employing the hand loom.

To assist the weaver in producing the desired article, the preferred loom material may serve the weaver as does graph paper the designer or draftsman. To assist the weaver in producing a desired article from detailed instructions, or even a picture, the loom preferably is divided into sections by color coding or otherwise marking every fifth grid bar in horizontal and vertical directions. Such counting, matching, and centering aids permit woven articles, especially intricate ones, to be produced quickly and accuratley, each article matching others produced to the same pattern. Patterns of large size, woven in sections, are usually accurate to within one stitch, or row of weaving. If the loom is constructed of a transparent material, or the grid is sufficiently open, a picture or sketch of the finished article even may be placed under the loom and followed by the weaver.

Figure 2:
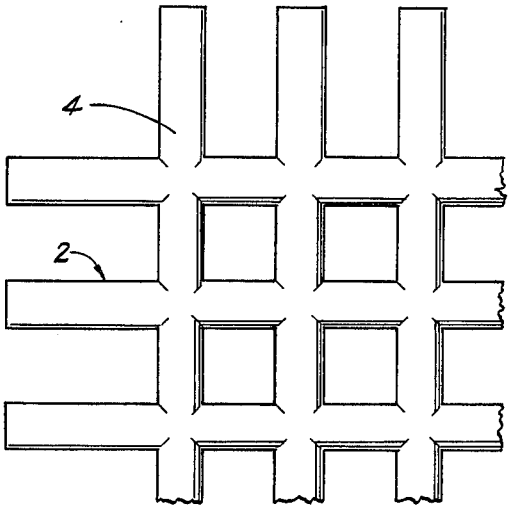
FIG. 2 is an enlarged view of a corner portion of the preferred hand loom.

In FIG. 2 is illustrated the preferred construction of the hand loom, this figure illustrating a corner portion of the loom shown in FIG. 1. The peripheral bars 4, preferably are fairly close together and are rather long — a quarter of an inch or more in length. They cooperate with adjacent bars to hold the threads between the bars, providing the advantages previously noted.

To improve thread retention, the peripheral bars may be provided with small lateral projections, or teeth, to catch and hold the thread, or the outer row of squares in the matrix cut open to permit the threads to be seated in these squares, or a loop of thread tucked through a closed square. This is particularly helpful when working with unruly warp threads. Also, a rubber band can be interlaced across the bars, or tape, or a clamp can be applied to the ends of the bars to secure the threads if needed, and the weaving will not release until the weaver chooses. To this end, the bars being co-planar with the sheet are a real advantage to the weaver.

Figure 3:
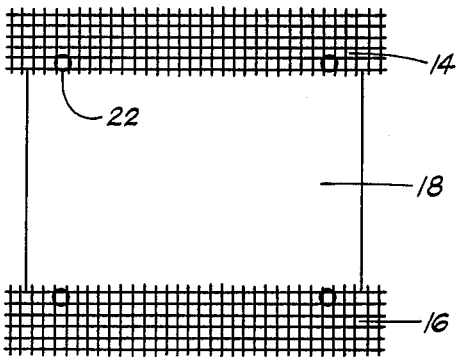
FIG. 3 is a plan view of a composite loom made by attaching the preferred hand loom to a panel.

For large weaving projects, two or more hand looms may be attached to an intermediate panel as shown in FIG. 3. These hand looms 14 and 16, illustrated as rectangular in shape, may be constructed in the same manner as the hand loom illustrated in FIG. 1. While the intermediate panel 18 may be of most any material, preferably it is sufficiently durable and resilient to resist degradation by the forces exerted during the weaving process. Examples of such a panel material include stiff rubber, aluminum, plastic, and a thin wood or bakelite panel. In some cases even a stiff cardboard might be used. Since hand looms 14 and 16 are resilient, these will accomodate the reduction in warp span which occurs during the weaving process, maintaining a constant light tension in the warp threads as previously noted, and panel member 18 need not be resilient.

Hand looms 14 and 16 may be attached to panel 18 in any convenient manner. One simple way to achieve this is by means of fasteners 22, which may be typical paper fasteners. The legs of these fasteners are passed through openings in the panel portion of the hand loom and through corresponding openings in the panel 18, the head of the fastener seating on the hand loom and the legs being splayed out beneath the panel.

Such an enlarged hand loom may be employed in the same fashion as the hand loom illustrated in FIG. 1, its increased size permitting a longer span of weaving and a wider variety of weaving projects. For example, in addition to warp threads extending traversly across the panel generally perpendicular to the hand loom 14 and 16, additional warp threads may be employed that extend diagonally across the panel to produce in the article interesting bias woven patterns. These additional warp threads may be seated in the slots between the peripheral bars of the opposed hand looms since these spaces are more than sufficient to accommodate multiple threads. Of course, such diagonal or bias weaving projects also may be made in a single hand loom as well.

Figure 4:
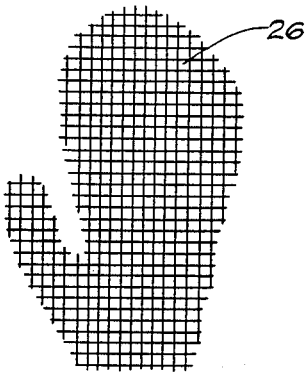
FIG. 4 is a plan view of another preferred form of the hand loom shaped in the form of the article to be woven.

The hand loom may be cut, or formed in most any shape, such as a shape approximating the finished article. For example, as illustrated in FIG. 4, if a mitten is to be woven, the hand loom 26 may be cut to a mitten shape. This hand loom may be employed to completely weave the finished article in one operation, the warp and weft threads both extending from one face of the loom about the peripheral edge and across the other face. Specifically, the warp threads may begin at the cuff or base of the mitten, extend up one side or face of the mitten, pass over the upper edge of the mitten between the peripheral bars there provided and down the opposite face to be hooked about a peripheral bar at the base of the mitten then passed back across the face that it just covered. This will result in a series of loops about the cuff which in turn will provide the desired opening in the finished article. The weft threads may begin at the fingertip portion of the mitten, extending across one face then about the edge and across the other face, encircling the mitten at each passage. After entirely weaving the mitten with weft threads in this fashion, the final weft thread is looped through the warp thread loops at the base or cuff of the mitten as the loops are removed from the peripheral bars to complete the mitten. The hand loom then is removed from within the finished mitten and used to weave the second mitten of the pair in the same manner. Socks or other articles may be woven in a similar fashion. At times it may be desirable to leave the resilient hand loom within the woven article to serve as a reinforcement for it or to avoid the need for blocking. For example, a purse may be completely woven, including a flap portion, the hand loom extending about the inside surface of the purse from the flap to the opposed edge defining the opening to the interior of the purse. Not only will the loom reinforce such an article, it will also render it more durable.

Figure 5:
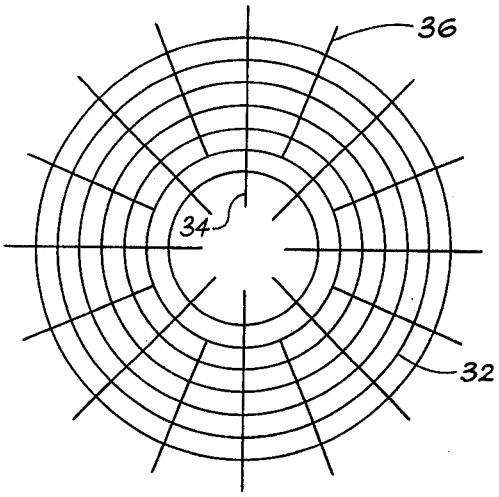
FIG. 5 is a plan view of another version of the preferred hand loom.

While the illustrated hand looms employ a panel defining a grid of bars perpendicular to one another, the hand loom may be formed with bars and panel members intersecting in most any fashion. For example, bars intersecting to define a hexagonal panel member may be used, or a panel member with a series of spaced circular openings may be used, or a panel member with intersecting radial and circumferential bars may be provided as illustrated in FIG. 5. Furthermore, as illustrated in this figure, an interior section of the panel member 32 may be removed to provide internally projecting peripheral bars 34. These bars may be employed in various unique ways. For example, the warp may be looped about the interior bars 34, passed over the outer periphery of the panel member then across the entire back face to circle back and loop about at a peripheral bar diametrically opposed to the first peripheral bar and this process repeated until the entire loom is covered with warp threads. Then the weft thread may start at the center of the back panel, weaving across the intersection of the warp threads and thereafter spiraled outward until it passes over the outer edge of the panel member and is spiraled inward to complete the article by picking up the loops about the interior bars 34. In this fashion, a complete beret or other similar article may be woven in a unitary manner. If the warp thread is looped about the interior bars 24 on both sides of the loom to leave the center portion open, and the weft threads woven as just described, a steering wheel cover or similar article may be completely woven in one operation. As another example of the usefulness of the interior bars 34, when a circular panel is desired to be woven some of the warp threads may extend completely across the panel from one outer peripheral bar 36 to the diametrically opposed peripheral bar 36 while adjacent warp threads may extend between outer peripheral bars 36 and inner peripheral bar 34. Thus, only a few of the warp threads will extend across the center portion of the circular panel. Then, the weft threads may commence at the center portion of the panel, weaving across the intersection of the few warp threads there and spiralling outward until it picks up the warp threads looped about the interior bars 34. Thereafter the weft thread will spiral outward until it picks up the warp threads looped about peripheral bars 36 to complete the circular panel.

As this description and multiple examples illustrate, the resilient hand loom provided by this invention is simple and durable, and provides exceptional versatility, and is an article useful for a variety of weaving projects. The loom permits the warp to be applied in any direction, and the length of the warp also may be selected to suit the weaver. It can usually be preplanned to an accuracy of one stitch. Every single peripheral bar (or slit) and every single aperture from both the top and reverse sides can be immediately interconnected by a warp or filament and adjusted to the desired tension of weaving, i.e., taut but not too tight. Further, with a few simple weaving techniques and weaving accessories, the warping can be designed so the woven article will have a finished edge where desired instead of a cut-off and tie or fringed edge. Articles can be woven up to double the length of the loom or up to double its width, and in any lesser dimension. With modest accessories (rollers or extending panels) the dimensions can be far greater.

In the preferred construction, the hand loom does not bend or bow only as a unit, but responds differentially at points of applied tension. It is less obtrusive in the hand and more conforming to hand weaving motions. A section can be bent to release one or a group of warps quickly, and the rest remain in place. It virtually solves the problems connected with the increasing warp tension inherent in hand loom weaving. Where tension adjustment must be made on long projects, it is very simple, such as by changing the position of several holding brads to different apertures.

Conventional "granny squares" and pot holders may be woven on the hand loom too, of course. Removing the adjacent loops of a pot holder to chain them together and complete the pot holder is quite simple with this loom since each peripheral bar may be worked independently of the rest. It is an ideal loom for teaching students weaving since it admits of an infinite variety of projects. In addition, it allows the student to focus his attention on the weaving process, rather than struggling to maintain the integrity of the loom. Also, the disclosed hand loom permits entire articles to be woven by hand simply by weaving over the edge of the hand loom from one face to another.

Figure 6:
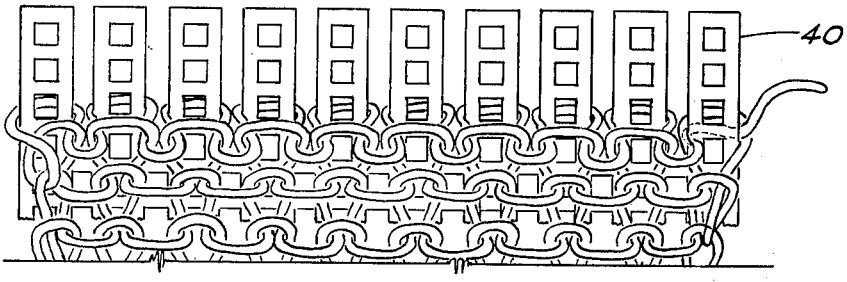
FIG. 6 is a plan view of the hand loom being employed in a knitting project.

As a further illustration of the amazing versatility of this simple loom, it also may be used to form knitted articles. Such an article is illustrated in FIG. 6. To commence the project, on the loom 40, a thread 42 is looped over lateral bars 44 about the periphery of the loom until the desired size of the article is attained. Then a second round of loops are laid over the bars, and the first round pushed over the second and off the bars. Round after round of loops may be added each time the previous round being pushed off to form another length of the knitted article. A pointed tool can help in lifting each interior loop over the exterior loop then off the bar. Of course, the knitted article may be tubular simply by continuing the thread in one direction around and around the periphery of the loom, the loops applied during the previous round being lifted off as the knitting progresses.

Figure 7:
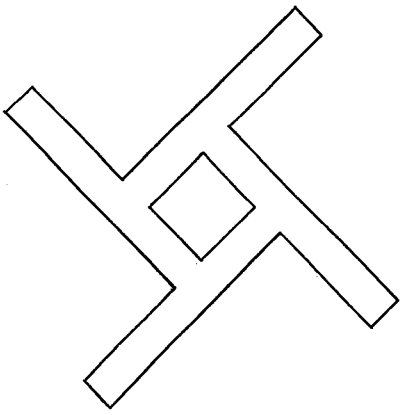
FIG. 7 is a plan view of another form of the hand loom useful in knitting projects.

Knitting tubular articles may be aided by employing a loom with a central opening, a very simple version of such a loom being illustrated in FIG. 7. In using this loom, the yarn loops are lifted up off the bars and passed through the central opening. The yarn can be applied in either direction, or to be reversed while the project is in progress, while the loom is held with one hand in a comfortable, handworking position. The knitting project can be continued with projects on other looms, and be varied in many fashions, being limited only by the imagination of the user.

While the preceeding examples of knitting employing the hand loom generally refer to rectangular shaped looms, of course the technique and loom is not so limited. For example, the round loom illustrated in FIG. 5 may be employed in a knitting project to generate knitted fabric of a varying width with the inwardly pointing bars 34, the user simply loops every other bar completely around the circle, then loops a second row and pushes off the first row. This continues to the desired depth of the first section. For the next section the user includes additional bars in the circle until all the bars are in use. The width of the fabric may be reduced in a similar fashion if desired by dropping bars during each cycle. The opening of the knitted section may be closed with a tie and bow, or with a strand of yarn, or in any other desired fashion.

There are many other knitting stitches and patterns which may be created simply by changing the number of bars wound and the direction and order of winding the loops. In view of the foregoing examples, these variations will be apparent to the experienced knitter.

While preferred embodiments of the invention have been described, variations will be apparent to those skilled in this art. Accordingly, the scope of the invention is defined by the following claims.

I claim:

1. A loom adapted to hold threads interwoven to form a fabric, the loom including a resilient sheet incorporating a series of regularly spaced openings to define a grid, the sheet being sufficiently flexible to accommodate a reduction in the fabric's span as the threads are interwoven, and peripheral bars attached to, co-planar with and projecting from the resilient sheet, the bars being the size and location to permit threads to be wrapped about them, the peripheral bars being formed of a resilient material.

2. A loom as set forth in claim 1 in which the periphery of the sheet defines a parallelogram, a series of peripheral bars being provided along all four edges of the sheet in line with the grid, and in which the sheet and peripheral bars are formed as a unitary article of a thermoplastic material.

3. A loom as set forth in claim 1 in which the peripheral bars include means to assist in holding the threads between them.

4. A loom as set forth in claim 1 in which the sheet includes an interior open area, peripheral bars being attached to the resilient sheet and projecting into this open area.

5. A loom as set forth in claim 1, the loom being shaped to approximate the shape of the object to be woven.

6. A loom as set forth in claim 1 of a generally circular shape, the peripheral bars extending radially outward from the resilient sheet.

7. A loom as set forth in claim 6 including an interior opening, peripheral bars being attached to the resilient sheet and extending radially inward into the opening.

* * * * *